US010188175B2

(12) United States Patent
Hsiung

(10) Patent No.: US 10,188,175 B2
(45) Date of Patent: Jan. 29, 2019

(54) BUCKLE ASSEMBLY AND RESPIRATORY MASK INCLUDING THE SAME

(71) Applicant: Besmed Health Business Corp., New Taipei (TW)

(72) Inventor: Tao Tsun Hsiung, New Taipei (TW)

(73) Assignee: BESMED HEALTH BUSINESS CORP., New Taipei (TW)

( * ) Notice: Subject to any disclaimer, the term of this patent is extended or adjusted under 35 U.S.C. 154(b) by 638 days.

(21) Appl. No.: 14/311,265

(22) Filed: Jun. 21, 2014

(65) Prior Publication Data

US 2015/0289598 A1 Oct. 15, 2015

(30) Foreign Application Priority Data

Apr. 15, 2014 (TW) ..... 103206538 U

(51) Int. Cl.

| | |
|---|---|
| ***A62B 9/04*** | (2006.01) |
| ***A44B 11/00*** | (2006.01) |
| ***A62B 18/02*** | (2006.01) |
| ***A62B 18/08*** | (2006.01) |
| ***A44B 11/25*** | (2006.01) |
| ***A44B 13/00*** | (2006.01) |

(52) U.S. Cl.

CPC ..... *A44B 11/005* (2013.01); *A44B 11/2588* (2013.01); *A44B 13/0029* (2013.01); *A62B 18/02* (2013.01); *A62B 18/084* (2013.01)

(58) Field of Classification Search

CPC .... A62B 9/00; A62B 9/02–9/027; A62B 7/00; A62B 7/04; A62B 7/14; A62B 18/00; A62B 18/10; A61M 2016/0015–2016/0042; A61M 16/0003–16/0009; A61M 16/20–16/209; A61M 16/06–16/0694; A61M 16/00

See application file for complete search history.

(56) References Cited

U.S. PATENT DOCUMENTS 6,019,101 A * 2/2000 Cotner ..... A61M 16/06 128/206.18

2011/0265791 A1* 11/2011 Ging ..... A61M 16/06 128/202.27

* cited by examiner

*Primary Examiner* — Gregory Anderson
*Assistant Examiner* — Ned T Heffner
(74) *Attorney, Agent, or Firm* — Bacon & Thomas, PLLC

(57) ABSTRACT

A buckle assembly for a respiratory mask comprises a female part and a male part. The female part includes top and bottom walls and a curved vertical wall. The top wall is formed with a top pivot hole and a top guiding groove. The bottom wall is formed with a bottom pivot hole and a bottom guiding groove. The male part includes a hook section that has a free end formed with top and bottom pivot protrusions that are slidable respectively along the top and bottom guiding grooves into the top and bottom pivot holes, respectively, so as to bring the male part to pivot relative to the female part between a first angular position and a second angular position in which the curved vertical wall and the hook section hook to each other.

6 Claims, 4 Drawing Sheets

BUCKLE ASSEMBLY AND RESPIRATORY MASK INCLUDING THE SAME

CROSS-REFERENCE TO RELATED APPLICATION

This application claims priority of Taiwanese Application No. 103206538, filed on Apr. 15, 2014.

BACKGROUND OF THE INVENTION

1. Field of the Invention

This invention relates to a buckle assembly and a respiratory mask including the same, more particularly to a buckle assembly including a female part formed with pivot holes and guiding grooves respectively extending away from the pivot holes.

2. Description of the Related Art

A conventional quick release buckle assembly normally includes a female part and a male part that is detachably engageable with the female part. The female part may define an insertion slot or hole, and have a catch that is disposed adjacent to or in the insertion slot. The male part may have a tongue member that is insertable into or through the insertion slot or hole to engage the catch in a snap-fit engaging manner. Taiwanese Utility Model Patent No. M464183 discloses a respiratory mask with a buckle assembly that has male and female parts similar to those of the aforementioned conventional quick release buckle assembly.

SUMMARY OF THE INVENTION

An object of the present invention is to provide a buckle assembly that is adapted for use on a respiratory mask and that has a simple structure and is easy to operate.

According to one aspect of this invention, there is provided a buckle assembly for a respiratory mask. The buckle assembly comprises a female part and a male part. The female part includes top and bottom walls and a curved vertical wall extending between the top and bottom walls in a vertical direction and cooperating with the top and bottom walls to define a first open recess thereamong. The top wall is formed with a top pivot hole and a top guiding groove extending away from a periphery of the top pivot hole. The bottom wall is formed with a bottom pivot hole and a bottom guiding groove extending away from a periphery of the bottom pivot hole. The bottom guiding groove is aligned with the top guiding groove along the vertical direction. The bottom pivot hole is aligned with the top pivot hole along the vertical direction. The curved vertical wall has a free end extending between the top and bottom walls. The male part includes an arm section, and a hook section that extends curvedly from the arm section, that defines a second open recess, that has a free end, and that is insertable into the first open recess in the female part. The free end of the hook section is formed with top and bottom pivot protrusions that are aligned with each other along the vertical direction and that are respectively slidable on and along the top and bottom guiding grooves into the top and bottom pivot holes, respectively, so as to bring the male part to detachably pivot relative to the female part between a first angular position, in which the free end of the curved vertical wall is disposed outwardly of the second open recess, and a second angular position, in which the free end of the curved vertical wall is disposed in the second open recess and in which the curved vertical wall and the hook section hook to each other.

According to another aspect of this invention, there is provided a respiratory mask the comprises a mask body and a buckle assembly connected to the mask body and including a pair of female parts, a pair of male parts, and an elastic strap that interconnects the male parts. The female parts are fixed to two opposite sides of the mask body, respectively. Each of the female parts includes top and bottom walls and a curved vertical wall extending between the top and bottom walls in a vertical direction and cooperating with the top and bottom walls to define a first open recess thereamong. The top wall is formed with a top pivot hole and a top guiding groove extending away from a periphery of the top pivot hole. The bottom wall is formed with a bottom pivot hole and a bottom guiding groove extending away from a periphery of the bottom pivot hole. The bottom guiding groove is aligned with the top guiding groove along the vertical direction. The bottom pivot hole is aligned with the top pivot hole along the vertical direction. The curved vertical wall has a free end extending between the top and bottom walls. Each of the male parts is detachably and pivotally engageable with a corresponding one of the female parts, and includes an arm section and a hook section that extends curvedly from the arm section, that defines a second open recess, that has a free end, and that is insertable into the first open recess. The free end of the hook section is formed with top and bottom pivot protrusions that are aligned with each other along the vertical direction and that are respectively slidable on and along the top and bottom guiding grooves into the top and bottom pivot holes, respectively, so as to bring each of the male parts to detachably pivot relative to the corresponding one of the female parts between a first angular position, in which the free end of the curved vertical wall is disposed outwardly of the second open recess, and a second angular position, in which the free end of the curved vertical wall is disposed in the second open recess and in which the curved vertical wall and the hook section hook to each other.

BRIEF DESCRIPTION OF THE DRAWINGS

In drawings which illustrate an embodiment of the invention.

DETAILED DESCRIPTION OF THE PREFERRED EMBODIMENT

Figure 1:
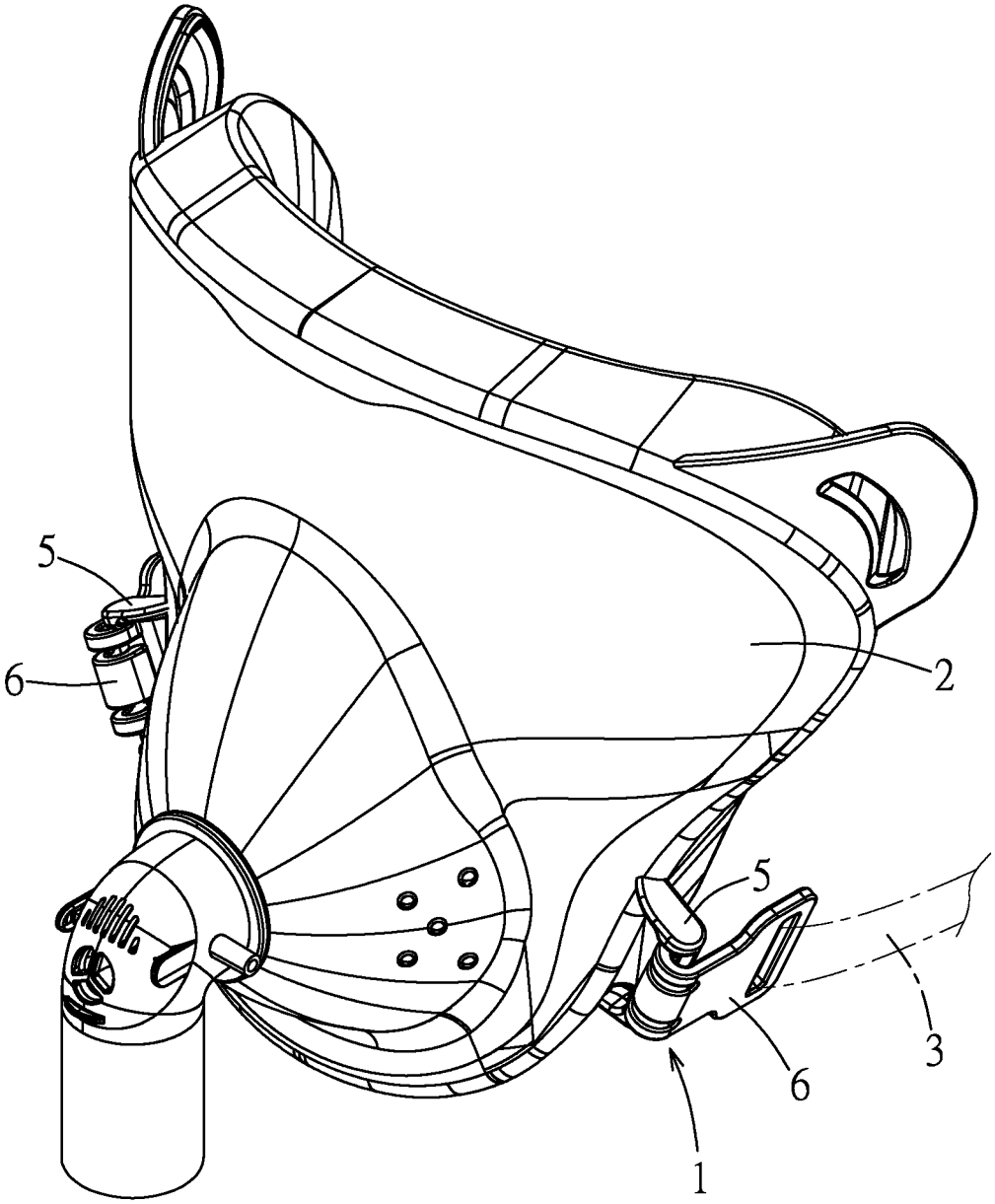
FIG. 1 is a fragmentary perspective view of the preferred embodiment of a respiratory mask according to the present invention.
Figure 2:
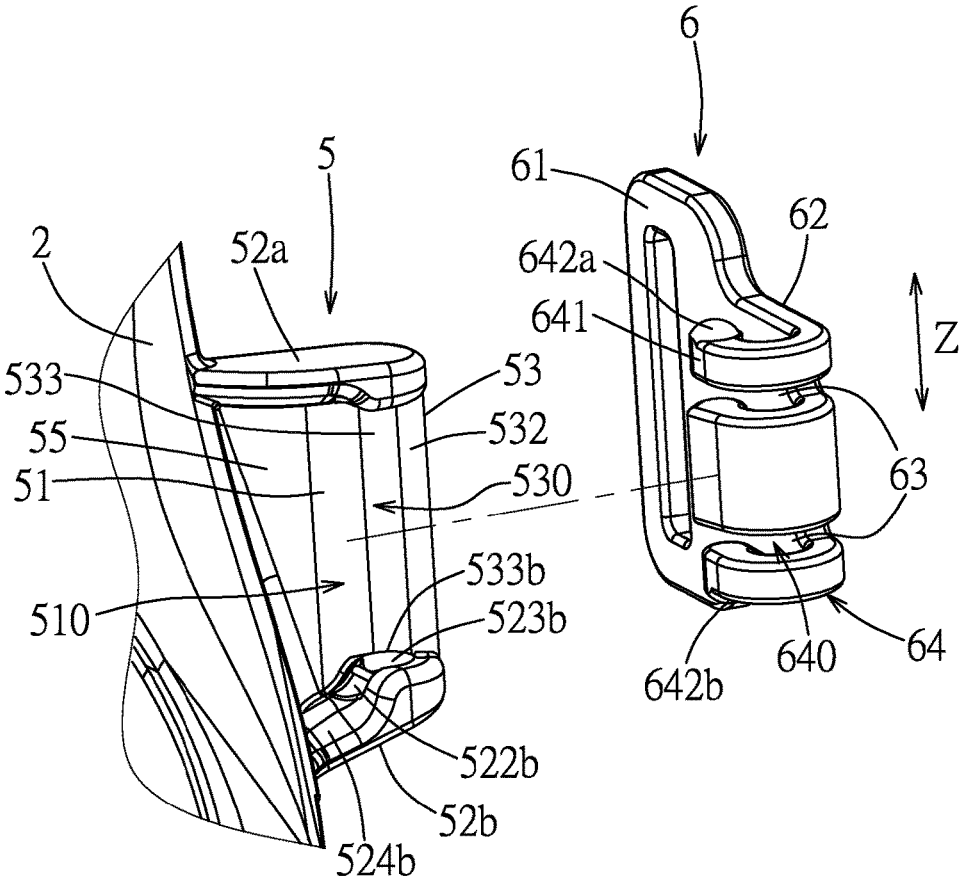
FIG. 2 is a fragmentary exploded perspective view of the preferred embodiment.
Figure 3:
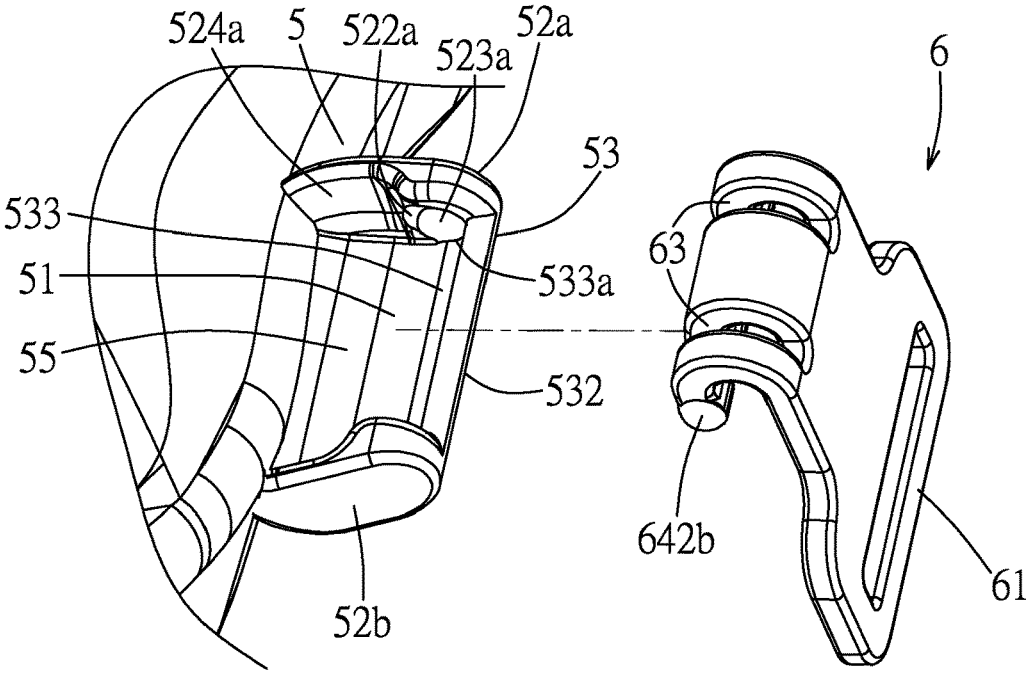
FIG. 3 is another fragmentary exploded perspective view of the preferred embodiment.
Figure 4:
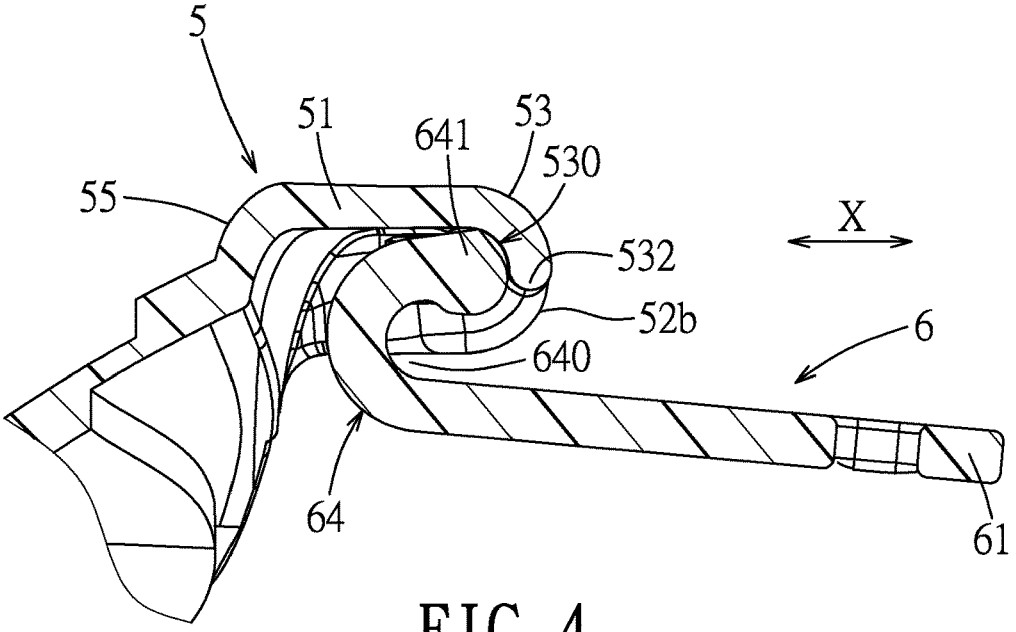
FIG. 4 is a fragmentary sectional top view of the preferred embodiment illustrating a state where a male part is disposed at a first angular position relative to a female part.

FIGS. 1 to 4 illustrate the preferred embodiment of a respiratory mask according to the present invention. The respiratory mask includes a mask body 2 and a buckle assembly 1 that is connected to the mask body 2 and that includes a pair of female parts 5, a pair of male parts 6, and an elastic strap 3 which interconnects the male parts 6. The female parts 5 are fixed to two opposite sides of the mask body 2, respectively.

Each of the female parts 5 includes top and bottom walls 52*a*, 52*b* and a curved vertical wall 53 extending between the top and bottom walls 52*a*, 52*b* in a vertical direction (Z) and cooperating with the top and bottom walls 52*a*, 52*b* to define a first open recess 530 thereamong. The top wall 52*a* is formed with a top pivot hole 523*a* (see FIG. 3) and a top guiding groove 522*a* that extends away from a periphery of the top pivot hole 523*a*, and has an inclined guiding surface 524*a* that extends from a periphery of the top guiding groove 522*a*. The bottom wall 52*b* is formed with a bottom pivot hole 523*b* and a bottom guiding groove 522*b* that extends away from a periphery of the bottom pivot hole 523*b*, and has an inclined guiding surface 524*b* that extends from a periphery of the bottom guiding groove 522*b*. The bottom guiding groove 522*b* is aligned with the top guiding groove 522*a* along the vertical direction (Z). The bottom pivot hole 523*b* is aligned with the top pivot hole 523*a* along the vertical direction (Z). The curved vertical wall 53 has a free end 532 extending between the top and bottom walls 52*a*, 52*b*, and an inner surface 533 having a top edge 533*a* which extends circumferentially along the periphery of the top pivot hole 523*a*, and a bottom edge 533*b* which extends circumferentially along the periphery of the bottom pivot hole 523*b*. Each of the female parts 5 further includes a non-curved vertical wall 51 that extends away from the curved vertical wall 53 in a lateral direction (X) transverse to the vertical direction (Z), and an inclined extension wall 55 that extends away from and is inclined to the non-curved vertical wall 51, and that is securely inserted into a wall of the mask body 2. The non-curved vertical wall 51 extends between and cooperates with the top and bottom walls 52*a*, 52*b* to define a outer open recess 510 adjacent to the first open recess 530. The curved and non-curved vertical walls 53, 51 cooperatively form a structure that has a generally hook-shaped cross-section.

Figure 5:
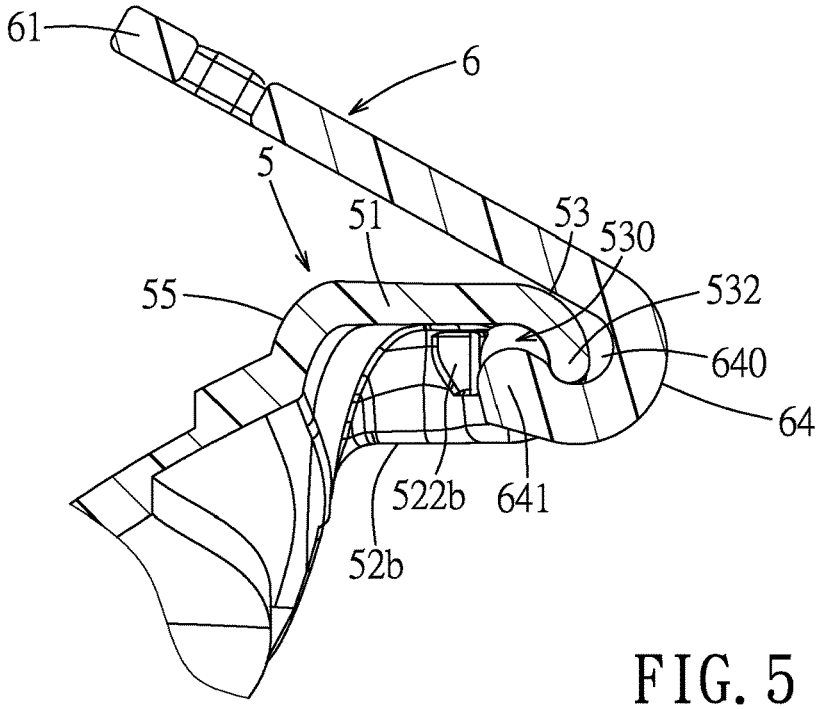
FIG. 5 is a fragmentary sectional top view of the preferred embodiment illustrating another state where the male part is disposed at a second angular position relative to the female part.
Figure 6:
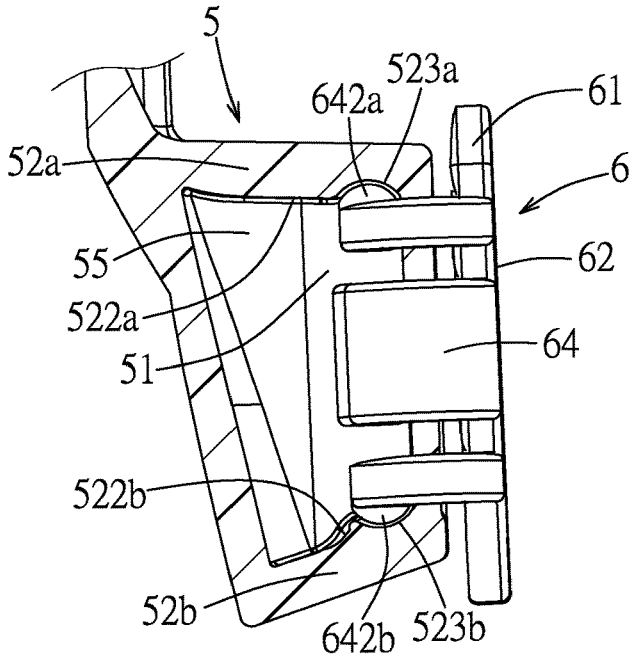
FIG. 6 is a fragmentary partly sectional side view of the preferred embodiment illustrating the state where the male part is disposed at the second angular position relative to the female part.

Each of the male parts 6 is detachably and pivotally engageable with a corresponding one of the female parts 5, and includes an arm section 62, a connecting section 61 and a hook section 64. The arm section 62 extends between the connecting section 61 and the hook section 64. The hook section 64 extends curvedly from the arm section 62, defines a second open recess 640, has a free end 641, and is slidabaly insertable into the first and outer open recesses 530, 510. The free end 641 of the hook section 64 is formed with top and bottom pivot protrusions 642*a*, 642*b* that are aligned with each other along the vertical direction (Z) and that are slidable along the top and bottom guiding grooves 522*a*, 522*b* into the top and bottom pivot holes 523*a*, 523*b*, respectively, so as to bring each of the male parts 6 to detachably pivot relative to the respective one of the female parts 5 between a first angular position (see FIG. 4), in which the free end 532 of the curved vertical wall 53 is disposed outwardly of the second open recess 640, in which the free end 641 of the hook section 64 extends into the first open recess 530 and in which the curved vertical wall 53 and the hook section 64 do not hook to each other, thereby permitting removal of the male part 6 from the corresponding female part 5, and a second angular position (see FIGS. 5 and 6), in which the free end 532 of the curved vertical wall 53 is disposed in the second open recess 640, in which the free end 641 of the hook section 64 extends into the first open recess 530 and in which the curved vertical wall 53 and the hook section 64 hook to each other, thereby preventing undesired removal of the male part 6 from the corresponding female part 5. In this embodiment, the hook section 64 is generally U-shaped, and is formed with upper and lower U-shaped slits 63 that extend through the free end 641 of the hook section 64 so as to permit elastic deformation of the free end 641 of the hook section 64 during insertion of the top and bottom pivot protrusions 642*a*, 642*b* into the top and bottom pivot holes 523*a*, 523*b* or removal of the top and bottom pivot protrusions 642*a*, 642*b* from the top and bottom pivot holes 523*a*, 523*b*.

The elastic strap 3 has two opposite ends connected respectively to the connecting sections 61 of the male parts 6 so as to bias each male part 6 to move to the second angular position when the elastic strap 3 is tensioned by being worn around a user's head.

In operation, the user can slide the hook section 64 of one of the male parts 6 into the first open recess 530 of one of the female parts 5 to pivot relative to said one of the female parts 5, and then use one hand to hold the mask body 2 on the user's face and the other hand to grip the elastic strap 3 to pass around the user's head and to slide the hook section 64 of the other of the male parts 6 into the first open recess 530 of the other of the female parts 5 to pivot relative to the other of the female parts 5. After the top and bottom pivot protrusions 642*a*, 642*b* of the hook section 64 of the other of the male parts 6 are respectively moved into the top and bottom pivot holes 523*a*, 523*b* of the other of the male parts 5, the elastic strap 3 automatically and elastically biases the male parts 6 to rotate to the second angular position.

With the hook section 64 of each male part 6 being slidable on the female part 5 to pivot relative to and to hook the curved vertical wall 53 of the corresponding female part 5, wearing of the respiratory mask on the user's head or removal of the respiratory mask therefrom is relatively easy.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A buckle assembly adapted for use in a respiratory mask, the respiratory mask including a mask body, said buckle assembly comprising:

a female part adapted to be fixed to a side of the mask body, and including top and bottom walls and a curved vertical wall that extends between said top and bottom walls in a vertical direction and that cooperates with said top and bottom walls to define a first open recess thereamong, said top wall being formed with a top pivot hole and a top guiding groove that extends away from a periphery of said top pivot hole, said bottom wall being formed with a bottom pivot hole and a bottom guiding groove that extends away from a periphery of said bottom pivot hole, said bottom guiding groove being aligned with said top guiding groove along the vertical direction, said bottom pivot hole being aligned with said top pivot hole along the vertical direction, said curved vertical wall having a free end that extends between said top and bottom walls; and a male part including an arm section and a hook section, wherein the arm section includes a major surface that defines a plane and the hook section extends curvedly from said arm section about an axis substantially parallel to said plane such that an inner surface of a free end of the hook portion faces said plane whereby said hook section is U-shaped and defines a second open recess, wherein the free end of the hook section is insertable into said first open recess in said female part, said free end of said hook section being formed with top and bottom pivot protrusions that are aligned with each other along the vertical direction and that are respectively slidable along said top and bottom guiding grooves into said top and bottom pivot holes, respectively, so as to bring said male part to detachably pivot relative to said female part between a first angular position, in which said free end of said curved vertical wall is disposed outwardly of said second open recess, and a second angular position, in which said free end of said curved vertical wall is disposed in said second open recess and in which said curved vertical wall and said hook section hook to each other, and wherein upper and lower U-shaped slits are formed substantially parallel to and spaced apart from one another in the hook section and extending through said free end of said hook section to define within said hook section a center hook portion and an outer hook portion spaced apart from each end of the center hook portion, the center hook portion and outer hook portions each being curved about said axis, so as to permit elastic deformation of said free end of said hook section during insertion of said top and bottom pivot protrusions into said top and bottom pivot holes, said top and bottom pivot protrusions being removable respectively from said top and bottom pivot holes when said male part is pivoted from the second angular position to the first angular position.

2. The buckle assembly of claim 1, wherein said curved vertical wall further has an inner surface that has a top edge which extends circumferentially along the periphery of said top pivot hole, and a bottom edge which extends circumferentially along the periphery of said bottom pivot hole.

3. The buckle assembly of claim 1, further comprising an elastic strap, said male part further including a connecting section, said arm section extending between said connecting section and said hook section, said elastic strap being connected to the mask body and said connecting section.

4. A respiratory mask comprising:

a mask body; and a buckle assembly connected to said mask body and including a female part fixed to a side of said mask body, a male part, and an elastic strap that interconnects said male part and said mask body;

wherein said female part includes top and bottom walls and a curved vertical wall extending between said top and bottom walls in a vertical direction and cooperating with said top and bottom walls to define a first open recess thereamong, said top wall being formed with a top pivot hole and a top guiding groove that extends away from a periphery of said top pivot hole, said bottom wall being formed with a bottom pivot hole and a bottom guiding groove that extends away from a periphery of said bottom pivot hole, said bottom guiding groove being aligned with said top guiding groove along the vertical direction, said bottom pivot hole being aligned with said top pivot hole along the vertical direction, said curved vertical wall having a free end that extends between said top and bottom walls; and wherein said male part is detachably and pivotally engageable with said female part and includes an arm section and a hook section, wherein the arm section includes a major surface that defines a plane and the hook section extends curvedly from said arm section about an axis substantially parallel to said plane such that an inner surface of a free end of the hook portion faces said plane whereby said hook section is U-shaped and defines a second open recess, wherein the free end of the hook section is insertable into said first open recess, said free end of said hook section being formed with top and bottom pivot protrusions that are aligned with each other along the vertical direction and that are respectively slidable on and along said top and bottom guiding grooves into said top and bottom pivot holes, respectively, so as to bring said male part to detachably pivot relative to said female part between a first angular position, in which said free end of said curved vertical wall is disposed outwardly of said second open recess, and a second angular position, in which said free end of said curved vertical wall is disposed in said second open recess and in which said curved vertical wall and said hook section hook to each other, and wherein upper and lower U-shaped slits are formed substantially parallel to and spaced apart from one another in the hook section and extending through said free end of said hook section to define within said hook section a center hook portion and an outer hook portion spaced apart from each end of the center hook portion, the center hook portion and outer hook portions each being curved about said axis, so as to permit elastic deformation of said free end of said hook section during insertion of said top and bottom pivot protrusions into said top and bottom pivot holes, said top and bottom pivot protrusions being removable respectively from said top and bottom pivot holes when said male part is pivoted from the second angular position to the first angular position.

5. The respiratory mask of claim 4, wherein said curved vertical wall further has an inner surface that has a top edge which extends along the periphery of said top pivot hole, and a bottom edge which extends along the periphery of said bottom pivot hole.

6. The respiratory mask of claim 4, wherein said buckle assembly includes two said female parts that are fixed respectively to opposite sides of said mask body, and two said male parts that are detachably, pivotally and respectively engageable with said female parts, said elastic strap interconnecting said male parts.

* * * * *